US010276955B2

(12) United States Patent
Lybrand et al.

(10) Patent No.: US 10,276,955 B2
(45) Date of Patent: Apr. 30, 2019

(54) ELECTRICAL CONNECTOR

(71) Applicant: AVX Corporation, Fountain Inn, SC (US)

(72) Inventors: Brent B. Lybrand, Moore, SC (US); Norman C. Huntley, Hertfordshire (GB); Tom Anderson, Mauldin, SC (US)

(73) Assignee: AVX CORPORATION, Fountain Inn, SC (US)

( * ) Notice: Subject to any disclaimer, the term of this patent is extended or adjusted under 35 U.S.C. 154(b) by 0 days.

(21) Appl. No.: 15/936,655

(22) Filed: Mar. 27, 2018

(65) Prior Publication Data

US 2018/0287277 A1 Oct. 4, 2018

Related U.S. Application Data

(60) Provisional application No. 62/480,006, filed on Mar. 31, 2017.

(51) Int. Cl.

| | |
|---|---|
| ***H01R 12/58*** | (2011.01) |
| ***H01R 13/05*** | (2006.01) |
| ***H01R 13/11*** | (2006.01) |
| ***H01R 9/24*** | (2006.01) |
| *H01R 4/2433* | (2018.01) |
| *H01R 4/242* | (2018.01) |

(52) U.S. Cl.

CPC ..... *H01R 12/585* (2013.01); *H01R 9/2416* (2013.01); *H01R 13/052* (2013.01); *H01R 13/111* (2013.01); *H01R 4/242* (2013.01); *H01R 4/2433* (2013.01)

(58) Field of Classification Search

CPC ..... H01R 4/242; H01R 4/2433; H01R 12/585

See application file for complete search history.

(56) References Cited

U.S. PATENT DOCUMENTS 4,676,579 A * 6/1987 Ting ..... H01R 12/58 439/82

4,909,754 A * 3/1990 Paradis ..... H01R 4/2429 439/395

(Continued)

FOREIGN PATENT DOCUMENTS

JP 2015-511379 A 4/2015

OTHER PUBLICATIONS

International Search Report and Written Opinion in PCT/US2018/025012 dated Jul. 17, 2018 (13 pages).

*Primary Examiner* — Tho D Ta

(74) *Attorney, Agent, or Firm* — Foley & Lardner LLP

(57) ABSTRACT

An electrical contact includes a main body and a compliant pin extending from the main body. The compliant pin includes a through-hole. The compliant pin is configured to be compressed. The electrical contact also includes a first leg and a second leg that each extend from the main body. The compliant pin is between the first leg and the second leg. The compliant pin, the first leg, and the second leg extend from the main body in a same direction. The electrical contact further includes a first blade and a second blade that each extend from the main body. A slot is formed between the first blade and the second blade, and a width of the slot is larger at a first position adjacent a distal end of the first and second blades than at a second position adjacent a proximal end of the first and second blades.

14 Claims, 4 Drawing Sheets

(56) References Cited

U.S. PATENT DOCUMENTS

| | | | | |
|---|---|---|---|---|
| 5,190,470 | A * | 3/1993 | Soes | H01R 4/2433 439/417 |
| 6,050,845 | A * | 4/2000 | Smalley, Jr. | H01R 4/2433 439/395 |
| 6,093,048 | A * | 7/2000 | Arnett | H01R 4/2416 439/404 |
| 6,616,459 | B2 * | 9/2003 | Norris | H01R 12/585 439/751 |
| 7,070,442 | B2 * | 7/2006 | Yamanashi | H01R 4/2433 439/404 |
| 8,062,058 | B1 * | 11/2011 | Moldoch | H01R 4/2429 439/404 |
| 8,684,761 | B2 * | 4/2014 | Weaver | H01R 4/242 136/244 |
| 8,702,442 | B2 * | 4/2014 | Debenedictis | H01R 4/2429 439/395 |
| 9,083,091 | B1 | 7/2015 | Ravlich | |
| 2005/0090155 | A1 | 4/2005 | Blossfeld | |
| 2006/0134966 | A1 | 6/2006 | Lappohn | |
| 2013/0065424 | A1 | 3/2013 | Parrish | |

* cited by examiner

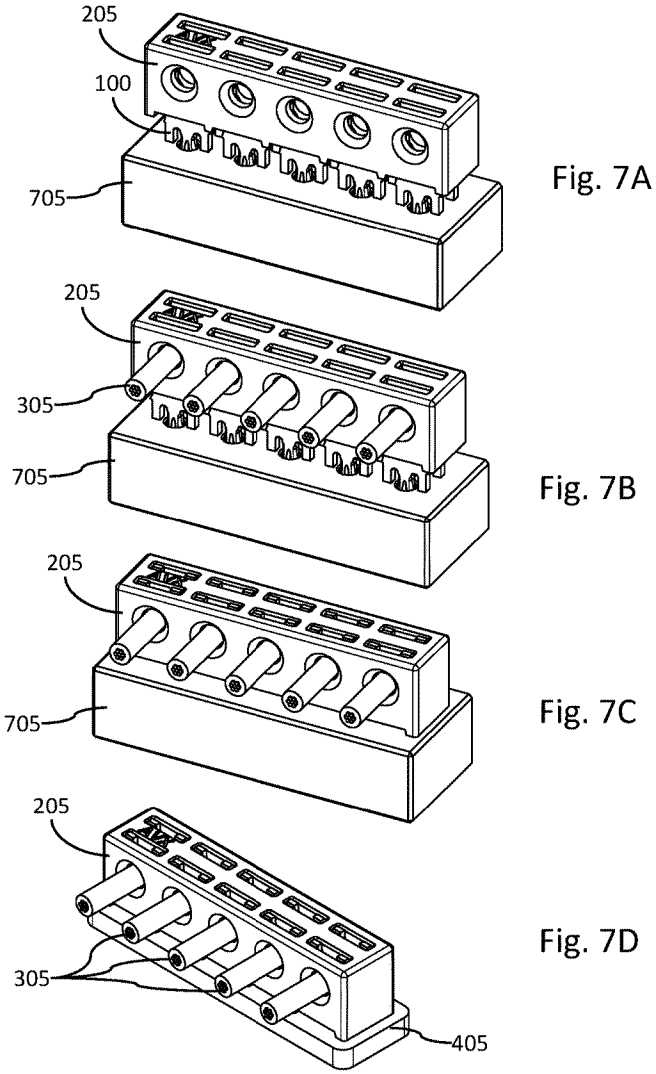
Fig. 7A
205
100
705
Fig. 7B
205
305
705
Fig. 7C
205
705
Fig. 7D
205
305
405
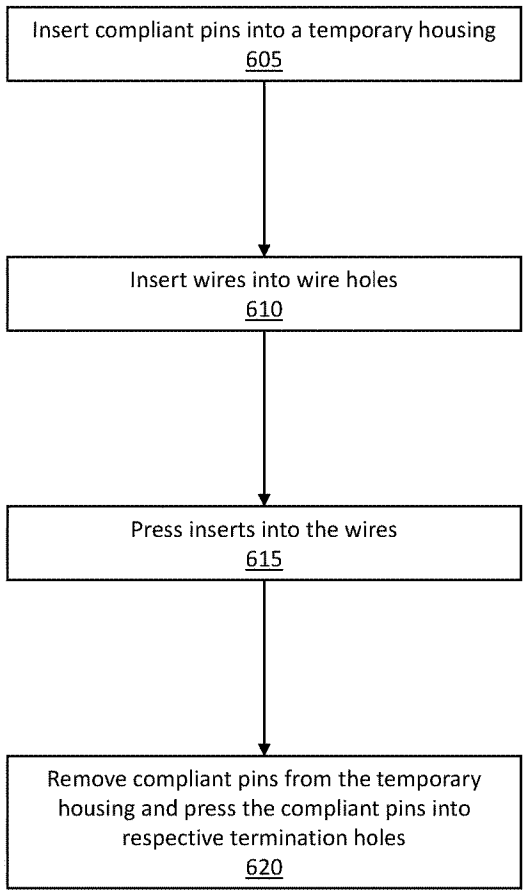
Fig. 6
Insert compliant pins into a temporary housing
605
Insert wires into wire holes
610
Press inserts into the wires
615
Remove compliant pins from the temporary housing and press the compliant pins into respective termination holes
620

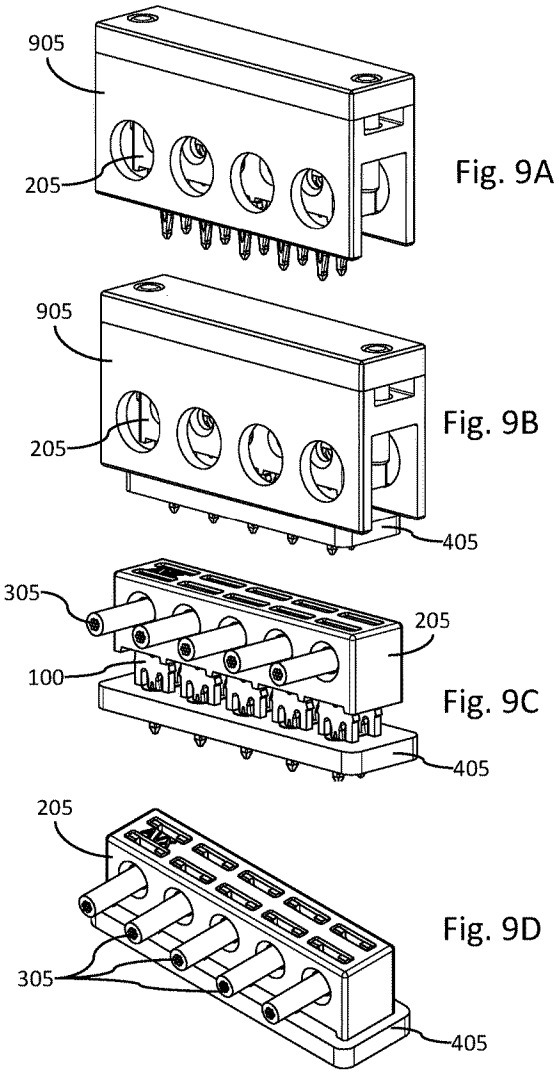
Fig. 9A
905
205
Fig. 9B
905
205
405
Fig. 9C
205
405
305
100
Fig. 9D
405
205
305
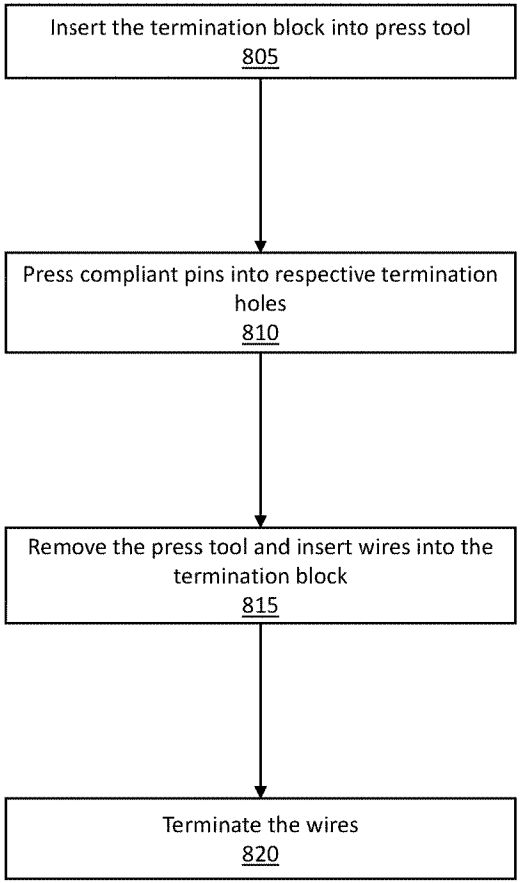
Fig. 8
Insert the termination block into press tool
805
Press compliant pins into respective termination holes
810
Remove the press tool and insert wires into the termination block
815
Terminate the wires
820

ELECTRICAL CONNECTOR

CROSS REFERENCE TO RELATED APPLICATION

This application claims priority to U.S. Provisional Application No. 62/480,006, filed Mar. 31, 2017, incorporated by reference in its entirety.

BACKGROUND

The following description is provided to assist the understanding of the reader. None of the information provided or references cited is admitted to be prior art. Electrical terminations are used to make an electrical connection between a wire and a circuit board or other electrical components. Various types of electrical terminations can be used such as soldering the wire to a pad on a circuit board, using a screw terminal, etc. Such electrical terminations may be practical or cost efficient for some applications, but other types of terminations may be more suitable to other applications.

SUMMARY

An illustrative electrical contact includes a main body and a compliant pin extending from the main body. The compliant pin includes a through-hole. The compliant pin is configured to be compressed. The electrical contact also includes a first leg and a second leg that each extend from the main body. The compliant pin is between the first leg and the second leg. The compliant pin, the first leg, and the second leg extend from the main body in a same direction. The electrical contact further includes a first blade and a second blade that each extend from the main body. A slot is formed between the first blade and the second blade, and a width of the slot is larger at a first position adjacent a distal end of the first and second blades than at a second position adjacent a proximal end of the first and second blades.

An illustrative termination block includes an electrical contact and an insulated housing. The electrical contact includes a main body and a compliant pin extending from the main body. The compliant pin includes a through-hole, and the compliant pin is configured to be compressed. The electrical contact also includes a first leg and a second leg that each extend from the main body. The compliant pin is between the first leg and the second leg. The compliant pin, the first leg, and the second leg extend from the main body in a same direction. The electrical contact further includes a first blade and a second blade that each extend from the main body. A first slot is formed between the first blade and the second blade. A width of the first slot is larger at a first position that is adjacent to a distal end of the first and second blades than at a second position that is adjacent to a proximal end of the first and second blades. The insulated housing includes a wire opening configured to receive the wire and a second slot that is configured to receive the first electrical contact. The wire opening intersects the second slot.

An illustrative termination method includes inserting a wire into a termination block. The termination block includes an insulated housing and an electrical contact. The method also includes sliding the electrical contact within the insulated housing such that the electrical contact displaces an insulation portion of the wire and makes electrical contact with a conductor of the wire. The method further includes pressing a compliant pin of the electrical contact into an electrically-conductive receptacle hole such that the compliant pin forms a mechanical and electrical connection the electrically-conductive receptacle hole.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

FIG. 6 is a flow chart of a method for terminating wires in accordance with an illustrative embodiment.

FIGS. 7A-7D are isometric views of components in various stages of the method of FIG. 6 in accordance with an illustrative embodiment.

FIG. 8 is a flow chart of a method for terminating wires in accordance with an illustrative embodiment.

FIGS. 9A-9D are isometric views of components in various stages of the method of FIG. 8 in accordance with an illustrative embodiment.

Figure 1:
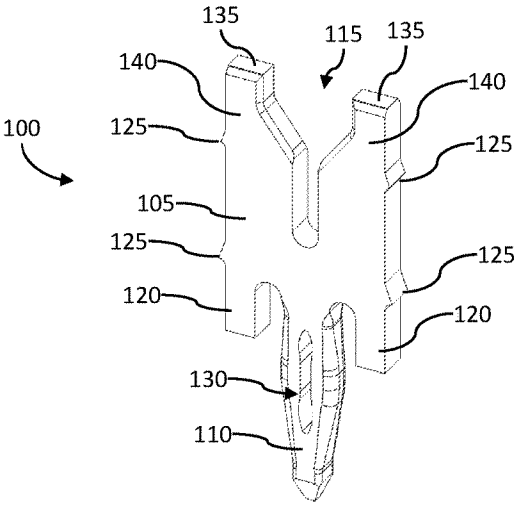
FIG. 1 is an isometric view of an electrical contact in accordance with an illustrative embodiment.

The foregoing and other features of the present disclosure will become apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Electrical equipment is used in many industries, and most of these industries have developed, over time, a standard or a typical method of making electrical connections between conductors. Such industry-specific types of electrical connections must be suitable for particular conditions associated with the specific industry. Certain industries (e.g., the automotive industry) require robust electrical connections in that the connections are resilient to significant shocks, vibration, temperature changes, and other forces that will tend to loosen or otherwise adversely affect the electrical and mechanical connections between conductors. In addition, in most industries (including the example automotive industry) it is preferable to use types of electrical connections that may be easily and quickly formed between conductors. Such electrical connections facilitate the construction of components within such industries by increasing construction speed and efficiency and reducing costs.

An insulation-displacement connector (IDC) is an electrical termination device that makes an electrical connection with a conductor of a wire by cutting or otherwise displacing the insulation of the wire, thereby exposing the conductor of the wire to the IDC. Some advantages of IDCs include ease of installation and low cost compared to other more difficult or expensive electrical connections (e.g., crimping or soldering). That is, IDCs generally have low manufacturing costs and are simple to use. For example, to make a connection with a wire, the wire is inserted into a hole of the IDC, and a blade is pushed against the wire within the housing of the IDC. As the blade is pushed against the wire, the blade cuts or otherwise displaces the insulation of the wire and makes an electrical connection with the conductor of the wire. However, IDCs have not been widely adopted by the automotive industry or other industries with similar needs because of a perceived lack of reliability. That is, previous IDCs would lose mechanical and electrical contact with the wire conductor when subjected to shocks, vibrations, temperature changes, etc.

In more recent times, the automotive industry and other industries requiring robust electrical connections have begun to use a press-fit or compliant pin type of connection. For example, wires can be crimped or soldered to a compliant pin, which, in turn, makes electrical contact with a circuit board or other receptacle. Compliant-pin type connections as discussed below facilitate creation of a robust electrical connection because the pin, which is in some cases pressed into a plated hole in a circuit board, presses against the walls of the plated hole, creating a relatively strong electrical and mechanical connection, which can be air-tight. The air-tight connection prohibits or retards oxidation of the metals (e.g., the metal of the compliant pin and/or the plating of the hole). Thus, even when exposed to relatively harsh environments such as wet and/or salty conditions, compliant pins retain a mechanical and electrical contact. Compliant-pin type connections are also relatively easy to use. For example, to make the mechanical and electrical connection, the pin is merely pushed into the plated hole.

Modern IDCs and wires can now be produced to tolerances that allow the electrical connection of an IDC to withstand operating conditions associated with a car or other automobile. Thus, IDCs can now be used to make a reliable electrical connection with wires. Accordingly, an IDC can be used to make a reliable connection between the wire and the connector, and a compliant pin can be used to make a reliable connection between the connector and, for example, a circuit board. Various embodiments described herein include a wire termination device that includes insulation-displacement and compliant-pin styles of electrical connections. Such a wire termination device may not use solder to connect wires to a circuit board, thereby decreasing complexity and difficulty of installation while increasing reliability. Such a device can be suitable for applications such as terminating wire looms in automobiles.

Using a compliant-pin connector and an IDC together provides benefits such as ease of installation or use and low cost. For example, such a connector does not require heat to make the connection between a wire and a circuit board, as is required with solder. Thus, compared to using solder to connect to either the wire or the circuit board, a compliant-pin/IDC does not introduce the possibility of damaging components with heat (e.g., melting insulation, heating sensitive electronics, burns, etc.). Further, no heat-up or cool-down time is required when using a compliant-pin/IDC.

In addition, in instances in which multiple wires are to be terminated on a circuit board (or other termination device), using an IDC type of connector may be more efficient than other termination styles such as crimping. Indeed, the connectors disclosed herein (e.g., connectors including IDC and compliant-pin components) greatly increase the efficiency with which electrical connections may be created between wires and other electrical components. For example, whereas crimping requires individually crimping a connector to each wire (i.e., each wire has its own crimped connection), one motion may be used to create an IDC connection for multiple wires. For example, as discussed in greater detail below, multiple IDCs can be mechanically but not electrically connected to one another (e.g., in a line). In such an example, multiple wires can each be inserted into a respective hole in the connector, and all IDC blades or contacts can be pressed into the housing of the IDC simultaneously, thereby decreasing time and effort to terminate multiple wires. In addition, the compliant-pin portions of the connectors discussed herein allow for relatively easy and efficient connection of multiple wires and connectors to PCBs or other electrical components.

FIG. 1 is an isometric view of an electrical contact 100 in accordance with an illustrative embodiment. An illustrative electrical contact 100 includes a main body 105, a compliant pin 110 with a through-hole 130, a slot 115, offset legs 120, retention ridges 125, and blades 140 with faces 135. In alternative embodiments, additional, fewer, and/or different elements may be used.

In an illustrative embodiment, the compliant pin 110 extends from the main body 105. As shown in FIG. 1, the compliant pin 110 can be tapered at each end. That is, the portion of the compliant pin 110 with the through-hole 130 is the widest portion, and the compliant pin 110 tapers down from the area of the through-hole 130 toward a distal end of the compliant pin 110 and also tapers down from the area of the through-hole 130 toward a proximal end of the compliant pin 110 (i.e., the portion of the compliant pin 110 that attaches to the main body 105). The through-hole 130 may allow the compliant pin 110 to deform or comply when pressed or forced through a hole (e.g., a hole in a circuit board). In an illustrative embodiment, the compliant pin 110 becomes more narrow around the portion with the through-hole 130 when squeezed into the hole in the circuit board. In the embodiment shown in FIG. 1, the end of the compliant pin 110 forms a tip, which can be used to easily direct the compliant pin 110 into a hole in a printed circuit board (PCB). The compliant pin 110 can be designed or formed such that, when pressed into a suitably sized hole on a PCB (or other electrical component), an outer surface of the compliant pin 110 presses against a perimeter of the hole, thereby forming an electrical and mechanical connection with the hole. For example, an outer surface of the complaint pin 110 can be rounded to approximate curvature of the hole. The compliant pin 110 and a perimeter surface of the hole may include one or more electrically-conductive materials, such as gold, nickel, etc., to facilitate the electrical connection there between. The outer surface of the compliant pin 110 may press against the perimeter surface of the hole with sufficient force to create an air-tight seal, thereby preventing or retarding oxidation of the materials the respectively electrically-conductive materials.

In an illustrative embodiment, the electrical contact 100 includes an offset leg 120 on either side of the compliant pin 110. The offset legs 120 may extend from the main body 105. The offset legs 120 may extend from the main body 105 a predetermined distance so as to control the maximum insertion distance of the compliant pin 110 into a corresponding plated hole of a circuit board (or other electrical component). The offset legs 120 may thereby prevent the compliant pin 110 from being pressed too far into the respective hole in the circuit board. In an embodiment, the offset legs 120 have a length such that, upon maximum insertion of a portion of the electrical contact 100 into the respective hole of the circuit board, at least a portion of the through-hole 130 will be positioned at a desired location within the respective hole of the circuit board to create an air-tight electrical and mechanical connection between the electrical contact 100 and the circuit board. Proper positioning of the area of the compliant pin 110 associated with the through-hole 130 is important because the through-hole 130 portion of the compliant pin 110 is the most compliant (e.g., spring-like) portion of the compliant pin 110 and allows for creation of the air-tight seal. In the embodiment shown in FIG. 1, the offset legs 120 and the through-hole 130 extend in a same general direction from the main body 105. In addition, a cross-section may be drawn through the electrical contact 100 that passes along a distal end of both of the offset legs 120 and through the through-hole 130. This cross-section is indicative of where the surface of the circuit board would be located upon maximum insertion of the compliant pin 110 into a respective hole of the circuit board.

The offset legs 120 may also provide a surface or end face that presses against a top surface of a circuit board. The offset legs 120 may be sufficiently robust to withstand pressing forces when the compliant pin 110 is pressed into the circuit board (or another supporting surface) without the electrical contact 100 buckling or crumpling. In some instances, the compliant pin 110 may be pressed into a circuit board before a wire is pressed into the slot 115 (discussed in greater detail below). In such instances, the offset legs 120 may be of sufficient strength and surface area such that the electrical contact 100 (e.g., the offset legs 120) is not pressed into or does not cut into the circuit board (or other supporting surface). That is, the offset legs 120 when pressed against the circuit board may provide a solid platform to allow a wire to be pressed into the slot 115.

The main body 105 may further include retention ridges 125. As discussed in greater detail below, the retention ridges 125 can be used to retain the electrical contact 100 within an insulated housing. For example, corresponding ridges or other protrusions or, in alternative embodiments, corresponding depressions can align such that the weight of the electrical contact 100 is not enough to allow the electrical contact 100 from falling out of the housing. In another example, the retention ridges 125 may be pressed against the insulated housing, thereby enhancing the friction between the electrical contact 100 and the insulated housing that resists movement of the electrical contact 100 within the insulated housing. For instance, the insulated housing may be plastic, and the electrical contact 100 may be a metal, such as copper (e.g., a high-strength copper alloy). The retention ridges 125 may cut, scrape, or otherwise deform an inside surface of the insulated housing to restrict movement of the electrical contact 100 within the housing. That is, the cutting, scraping, or other deformation may create a friction or resistive force that retains the electrical contact 100 within the insulated housing.

In an illustrative embodiment, blades 140 extend from the main body 105. The blades 140 form a slot 115 there between. The slot 115 can be an insulation-displacement slot that is configured to cut or otherwise penetrate through insulation of a wire, and form an electrical connection with the conductor of the wire. As shown in FIG. 1, an inside surface of the blades 140 (i.e., a portion of the surface that defines the slot 115) can be chamfered or otherwise shaped to create a cutting surface. The cutting surface can be designed or formed to cut through the insulation portion of a wire. In the embodiment illustrated in FIG. 1, the slot 115 includes a relatively wide opening at the mouth of the slot 115 (e.g., the end closest to the face 135) and tapers into a relatively narrow opening (e.g., at the end of the slot 115 closest to the compliant pin 110). That is, the width of the slot 115 is larger at a first position of the slot 115 that is adjacent to a distal end of the blades 140 than at a second position of the slot 115 that is adjacent to a proximal end of the blades 140. The proximal end of the blades 140 are the ends of the blades 140 that are connected to or proximate to the main body 105.

In an illustrative embodiment, the relatively wide opening is wide enough to receive an insulated wire, and the relatively narrow opening is narrow enough to contact, on opposite ends, the conductor of the insulated wire. Thus, as an insulated wire is forced from the relatively wide opening towards the relatively narrow opening, the electrical contact 110 forces an opening in the insulation portion of the wire and makes an electrical connection with the conductor of the wire. Although a particular shape of the slot 115 is shown in FIG. 1, any other suitable insulation-displacement shape may be used in other embodiments. For example, the width of the narrow opening can be adjusted to be suitable for a particular wire gauge, and the width of the wide opening can be adjusted to accommodate a particular thickness of insulation.

In an illustrative embodiment, the faces 135 are flat along a plane extending a set distance from the main body 105. That is, the faces 135 can provide a consistent, uniform, and/or flat surface upon which a force can be applied. For example, a flat surface of a tool or of an inner surface of an insulated housing can be used to simultaneously and equally press against the faces 135 to apply a force that causes the compliant pin 110 to be pressed into a hole (e.g., of a circuit board).

Figure 2:
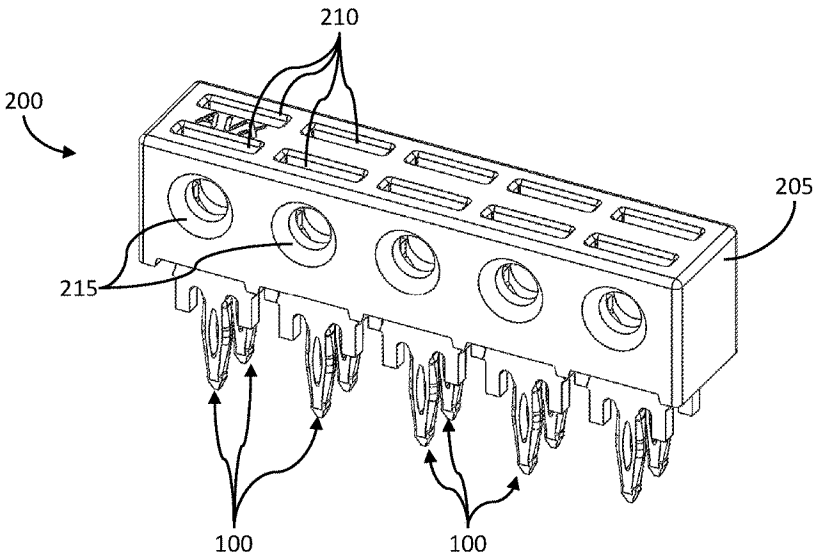
FIG. 2 is an isometric view of a termination block in accordance with an illustrative embodiment.

FIG. 2 is an isometric view of a termination block in accordance with an illustrative embodiment. The termination block 200 includes an insulated housing 205 and ten electrical contacts 100. The housing 205 includes electrical contact slots 210 and wire openings 215. In alternative embodiments, additional, fewer, and/or different elements may be used. For example, although FIG. 2 illustrates ten electrical contacts 100 and five wire openings 215, additional or fewer electrical contacts 100 and/or wire openings 215 may be used.

As illustrated in FIG. 2, an electrical contact 100 can be slid or otherwise fitted inside each slot 210. The housing 205 also includes wire openings 215 that are aligned with one or more electrical contact slots 210. Aligning the electrical contact slots 210 with the wire openings 215 helps to ensure that the conductor of the wire is aligned with the slot 115 of each electrical contact 100. In an illustrative embodiment, the wire openings 215 are each wide enough to accommodate a wire 305, but not wide enough to allow substantial movement of the wire 305 within the wire opening 215. Such tolerances can be used to improve alignment of the conductor of the wire 305 with the corresponding slot 115 and improve wire 305 retention, thereby increasing the reliability of the electrical connection between the wire 305 and the respective electrical contact 100.

In the position illustrated in FIG. 2, the termination block 200 is ready to receive (and terminate) wires. For example, the diameter of the wire openings 215 can be the same as or smaller than the relatively wide portion of the slot 115 of each electrical contact 100. Thus, an insulated wire can be inserted into the wire opening 215 and the wide opening of the corresponding electrical contact 100. Once the insulated wire is inserted, the electrical contact 100 can be pressed into the housing 205 such that the electrical contact 100 displaces the insulation of the wire, and the narrow portion of the slot 115 makes an electrical connection with the conductor of the wire. Similarly, the compliant pin 110 of the electrical contacts 100 can be pressed or otherwise fitted into corresponding holes in a circuit board or other electrical component, thereby creating an electrical connection between the conductor of the wire to a corresponding hole in the circuit board or other electrical component. In an illustrative embodiment, the holes in the circuit board may be plated with an electrically-conductive material. In alternative embodiments, the compliant pins 110 can be inserted into any other suitable hole, such as a corresponding female pin (e.g., of a wire loom connector or other receptacle).

In an illustrative embodiment, the electrical contacts 100 are made of a conductive material such as a metal. For example, the electrical contacts 100 can be made of copper, steel, stainless steel, an alloy, etc. In alternative embodiments, the electrical contacts 100 may be plated with a conductive material. In an illustrative embodiment, the housing 205 can be made of a non-conductive material or be coated with a non-conductive material. For example, the housing 205 can be made of plastic.

Figure 4:
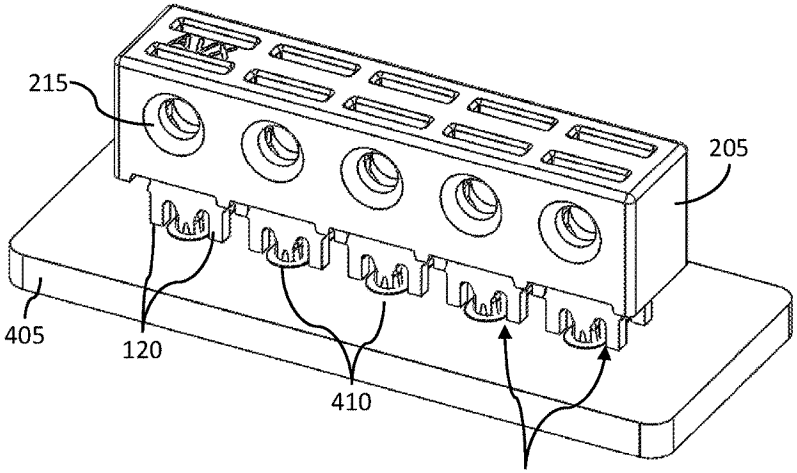
FIG. 4 is an isometric view of a termination block with electrical contacts electrically and mechanically coupled to a circuit board in accordance with an illustrative embodiment.
Figure 3:
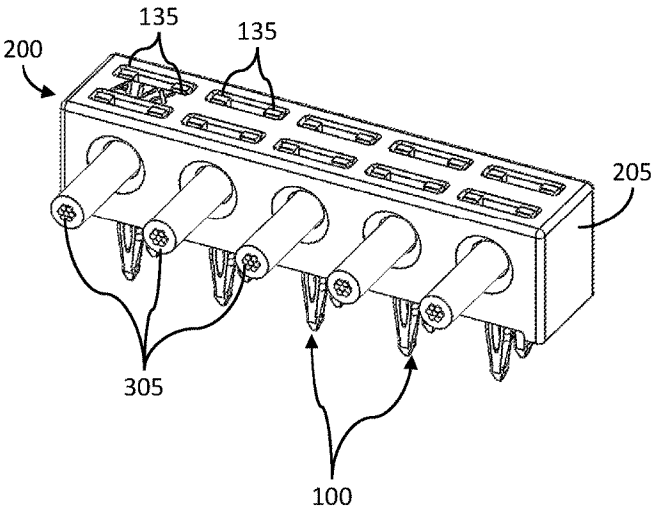
FIG. 3 is an isometric view of a termination block with terminated wires in accordance with an illustrative embodiment.
Figure 5:
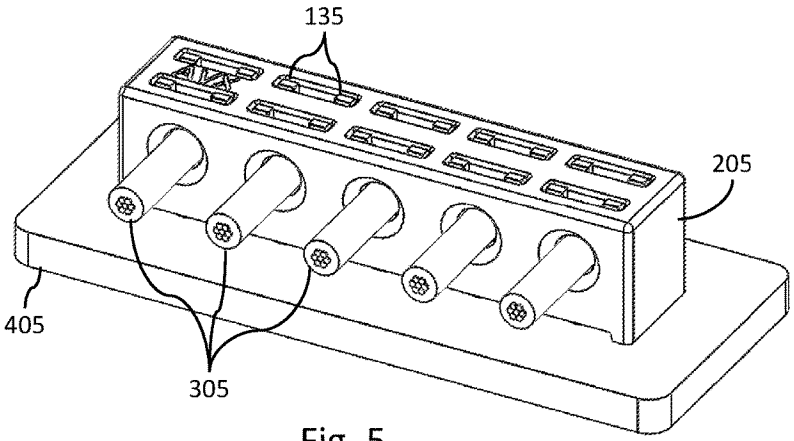
FIG. 5 is an isometric view of a termination block with terminated wires and electrical contacts in a circuit board in accordance with an illustrative embodiment.

FIG. 3 is an isometric view of a termination block with terminated wires in accordance with an illustrative embodiment. FIG. 4 is an isometric view of a termination block with electrical contacts in a circuit board in accordance with an illustrative embodiment. FIG. 5 is an isometric view of a termination block with terminated wires and electrical contacts in a circuit board in accordance with an illustrative embodiment. FIGS. 3-5 show the termination block 200 in various stages of termination.

FIG. 3 illustrates the termination block 200 with terminated wires 305, but without the compliant pins 110 connected to conductive holes of a corresponding electrical component. In such an embodiment, wires 305 may be inserted into the wire openings 215, and the electrical contacts 100 can be pressed into the housing 205, thereby creating an electrical connection between the electrical contacts 100 and the respective wires 305. The electrical contacts 100 can be pressed into the housing 205 by applying force onto the offset legs 120 of the electrical contacts 100. The cut-away view of the wires 305 shows multi-conductor insulated wires 305, although in alternative embodiments, solid conductor insulated wires may be used. The electrical contacts 100 of wire termination block 200 can be pressed into corresponding conductive holes 410 of a circuit board 405 to complete termination of the wires 305 to the circuit board 405, as shown in FIG. 5. For example, the faces 135 of the electrical contacts 100 can be pressed to force the respective complaint pin 110 into the holes 410 of circuit board 405. In the embodiment shown in FIG. 3, the faces 135 are flush or even with a top surface of the housing 205. In such an embodiment, a surface of a tool can be flat and apply an even and consistent force against each face 135 of each electrical contact 100.

FIG. 4 illustrates the termination block 200 with the compliant pins 110 terminated (e.g., inserted into corresponding holes 410 in the circuit board 405) but without terminated wires 305. As discussed in greater detail below, a force can be applied against the faces 135 of the respective electrical contacts 100 to press the compliant pins 110 into respective holes 410 in the circuit board 405 without pressing the electrical contacts 100 into the housing 205. That is, the compliant pins 110 can be pressed into the circuit board 405 while the wide portion of the slots 115 are still aligned with the wire openings 215 such that insulated wires can be inserted into the slots 115 after the compliant pins 110 are pressed into the circuit board 405. Once the complaint pins 110 are terminated, wires 305 can be inserted into the wire openings 215, and the wires 305 can be terminated to the electrical contacts 100 (e.g., by pressing the housing 205 toward or against the circuit board 405) to complete termination of the wires 305 to the circuit board 405, as shown in FIG. 5.

FIG. 5 illustrates the termination block 200 with the wires 305 terminated to the electrical contacts 100 and with the compliant pins 110 inserted into the circuit board 405. As discussed above, either the complaint pins 110 can first be inserted into the circuit board 405 or the wires 305 terminated to the electrical contacts 110. In an alternative embodiment, the wires 305 can be electrical contacted into the wire openings 215 and the compliant pins 110 aligned with respective holes 410 in the circuit board 405, and the housing 205 can be pressed toward the circuit board 405 to simultaneously terminate the wires 305 to the electrical contacts 100 and press the compliant pins 110 into the circuit board 405.

In the embodiment shown in FIG. 5, the termination block 200 can be used to terminate up to five wires. In alternative embodiments, the termination block 200 can use any other suitable number of wire openings 215 and corresponding number of electrical contacts 100. For example, the termination block 200 can include up to one, two, three, four, or six or more wire openings 215 and corresponding number of electrical contacts 100. Similarly, in the embodiment illustrated in FIG. 5, there are two electrical contacts 100 per wire 305. Such an embodiment provides a redundant contact between the wire 305 and the circuit board 405, thereby allowing a higher current capacity and mechanical strength compared to an embodiment in which one electrical contact 100 is used per wire 305. In alternative embodiment, any suitable number of electrical contacts 100 can be used per wire 305, such as one or three or more. In an alternative embodiment, wires 305 can be inserted into both sides of the housing 205, and each electrical contact 100 can be used to terminate one respective wire 305. Thus, the embodiment shown in FIG. 5 can be used to terminate ten wires 305. In such an embodiment, two opposing contacts can be separated far enough apart such that the respective wires 305 do not touch each other when installed.

FIG. 6 is a flow chart of a method for terminating wires in accordance with an illustrative embodiment, and FIGS. 7A-7D are isometric views of components in various stages of the method of FIG. 6. The use of a flow chart and/or arrows is not meant to be limiting with respect to the order or flow of operations. For example, in alternative embodiments, two or more operations may be performed simultaneously.

In an operation 605, compliant pins 110 are inserted into a temporary housing 705. As shown in FIG. 7A, the temporary housing 705 includes holes that align with the compliant pins 110. The holes are large enough that the compliant pins 110 do not fit snugly. For example, the holes may be large enough that the compliant pins 110 can move freely into or out of the holes. The holes may be narrow enough that a top surface of the temporary housing 705 sits flush against the offset legs 120.

In an operation 610, wires 305 are inserted into the wire openings 215, as shown in FIG. 7B. In the embodiment of FIG. 7B in which two electrical contacts 100 are used per wire 305, the wires 305 can be inserted into the housing 205 such that the conductors of each wire 305 extend past each respective electrical contact 100. That is, the wires 305 can be inserted into the housing 205 such that both respective electrical contacts 100 create an electrical connection with the conductor of the respective wire 305.

In an illustrative embodiment, each wire 305 is not stripped of insulation prior to formation of the electrical connection. That is, each wire 305 has insulation around the conductor such that the blades 140 of each electrical contact 100 cut into or otherwise displace a portion of the insulation. Once the insulation is displaced by the electrical contact 100, the insulation may press against side surfaces of the electrical contact 100, thereby restricting movement of the wire 305. By having insulation that the electrical contact 100 can displace, a more rigid and secure connection can be made with the wire 305. In alternative embodiments, the wires 305 may be partially stripped of insulation. For example, the wires 305 may have over-sized conductors such that the insulated wires 305 do not fit within the wire openings 215. In another example, the wire openings 215 may be undersized such that the conductors of the wires 305 without the insulation fit inside the wire openings 215.

In an operation 615, the electrical contacts 100 are pressed into the wires 305. For example, the housing 205 and the temporary housing 705 are pressed together, thereby pressing the electrical contacts 100 into the housing 205. When the electrical contacts 100 are pressed into the housing 205, the blades 140 displace the insulation of the wires 305 and make an electrical connection with the conductors of the wires 305. As shown in FIG. 7B, the end faces of the offset legs 120 sit flush against a top surface of the temporary housing 705. In such an embodiment, when the temporary housing 705 is pressed toward the housing 205, an equal and consistent force is applied against the end faces of the offset legs 120 simultaneously to force the blades 140 to displace the insulation. Thus, the offset legs 120 can be used to press the electrical contacts 100 into the housing 205 without stressing or deforming the compliant pins 110.

In an operation 620, the compliant pins 110 are removed from the temporary housing 705, and the compliant pins 110 are pressed into respective termination holes. In the embodiment shown in FIG. 7D, the compliant pins 110 have been pressed into holes in the circuit board 405. In alternative embodiments, the compliant pins 110 can be pressed into any other suitable electrical connection, such as a wiring harness connector.

FIG. 8 is a flow chart of a method for terminating wires in accordance with an illustrative embodiment, and FIGS. 9A-9D are isometric views of components in various stages of the method of FIG. 8. The use of a flow chart and/or arrows is not meant to be limiting with respect to the order or flow of operations. For example, in alternative embodiments, two or more operations may be performed simultaneously.

In an operation 805, the termination block 200 is inserted into a press tool 905, as in FIG. 9A. The press tool 905 is configured to apply a force against the electrical contacts 100 (e.g., on the faces 135) without applying a significant force on the housing 205. For example, the press tool 905 can include fingers that extend into the slots in the housing 205 and align with the faces 135. In an illustrative embodiment, about twenty pounds can be applied per compliant pin 110 to securely seat the compliant pins 110 into the holes in the circuit board 405.

In an operation 810, the compliant pins 110 are pressed into respective termination holes. In the embodiment illustrated in FIG. 9B, the press tool 905 has been pressed toward the circuit board 405 such that the compliant pins 110 are pressed into holes in the circuit board 405, without the electrical contacts 100 being pressed into the housing 205 (e.g., such that the wires 305 can be inserted into the housing 205).

In an operation 815, the press tool 905 is removed, and the wires 305 are inserted into the termination block 200, as shown in FIG. 9C. For example, the wires 305 can be inserted in a similar fashion as described above with respect to the operation 610. In an operation 820, the wires 305 are terminated. For example, as shown in FIG. 9D, the housing 205 has been pressed toward the circuit board 405, thereby pressing the wires 305 into the narrow portion of the slots 115 of the respective electrical contacts 100.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A termination method comprising:

inserting a wire into a termination block, wherein the termination block comprises an insulated housing and an electrical contact;

sliding the electrical contact within the insulated housing such that the electrical contact displaces an insulation portion of the wire and makes electrical contact with a conductor of the wire, wherein the sliding the electrical contact within the insulated housing comprises:

inserting the compliant pin into a hole in a temporary housing, and pressing the insulated housing of the termination block towards the temporary housing; and pressing a compliant pin of the electrical contact into an electrically-conductive receptacle hole such that the compliant pin forms a mechanical and electrical connection the electrically-conductive receptacle hole.

2. The termination method of claim 1, wherein the sliding the electrical contact is after the inserting the wire.

3. The termination method of claim 1, wherein the pressing the compliant pin is after the inserting the wire and the sliding the electrical contact.

4. The termination method of claim 1, wherein the inserting the wire and the sliding the electrical contact is after the pressing the compliant pin.

5. The termination method of claim 1, wherein the receptacle hole comprises a plated through-hole in a circuit board.

6. A termination method comprising:

inserting a wire into a termination block, wherein the termination block comprises an insulated housing and an electrical contact;

sliding the electrical contact within the insulated housing such that the electrical contact displaces an insulation portion of the wire and makes electrical contact with a conductor of the wire; and pressing a compliant pin of the electrical contact into an electrically-conductive receptacle hole such that the compliant pin forms a mechanical and electrical connection the electrically-conductive receptacle hole, wherein the pressing the compliant pin into the receptacle hole comprises:

inserting a finger of a press tool into a slot of the insulated housing, wherein the electrical contact is partially in the slot; and pressing the press tool towards the receptacle hole, wherein the finger of the press tool directly applies a force on the electrical contact that presses the compliant pin into the receptacle hole.

7. The termination method of claim 6, wherein the receptacle hole comprises a plated through-hole in a circuit board.

8. The termination method of claim 6, wherein the pressing the compliant pin creates an air-tight connection between the compliant pin and the electrically-conductive receptacle hole.

9. The termination method of claim 6, wherein the pressing the compliant pin causes a first offset leg and a second offset leg of the electrical contact to mechanically contact an area of a circuit board around the electrically-conductive receptacle hole.

10. The termination method of claim 6, wherein the pressing the compliant pin causes a through-hole portion of the compliant pin to compress as the compliant pin is pressed into the electrically-conductive receptacle hole.

11. The termination method of claim 6, wherein the sliding of the electrical contact causes retention ribs of the electrical contact to create a frictional force between the electrical contact and the insulated housing.

12. The termination method of claim 6, wherein the sliding the electrical contact within the insulated housing comprises:

inserting the compliant pin into a hole in a temporary housing, and pressing the insulated housing of the termination block towards the temporary housing.

13. The termination method of claim 6, wherein the sliding the electrical contact within the housing forces the wire into a mouth of a slot of the electrical contact.

14. The termination method of claim 13, wherein the sliding the electrical contact within the housing further forces the wire into a narrow portion of the slot.

* * * * *